US008156701B2

(12) United States Patent
Tsukada et al.

(10) Patent No.: US 8,156,701 B2
(45) Date of Patent: Apr. 17, 2012

(54) FLOOR SUPPORT AND FLOOR STRUCTURE

(75) Inventors: Masaru Tsukada, Yokohama (JP); Satoru Akutsu, Yokohama (JP); Kenji Inaba, Yokohama (JP)

(73) Assignee: Bridgestone Corporation, Tokyo (JP)

( * ) Notice: Subject to any disclaimer, the term of this patent is extended or adjusted under 35 U.S.C. 154(b) by 358 days.

(21) Appl. No.: 12/330,929

(22) Filed: Dec. 9, 2008

(65) Prior Publication Data

US 2009/0145057 A1 Jun. 11, 2009

(30) Foreign Application Priority Data

Dec. 10, 2007 (JP) ..... 2007-318584

(51) Int. Cl.
*E04B 5/00* (2006.01)

(52) U.S. Cl. ..... 52/263; 52/167.7

(58) Field of Classification Search ..... 52/126.5, 52/126.6, 263, 403.1, 167.7
See application file for complete search history.

(56) References Cited

U.S. PATENT DOCUMENTS 4,156,048 A * 5/1979 Davis ..... 428/354
4,991,366 A * 2/1991 Teramura et al. ..... 52/167.8
5,452,549 A * 9/1995 Medeot et al. ..... 52/167.8
5,501,754 A * 3/1996 Hiraguri ..... 156/71
5,884,440 A * 3/1999 Kubo et al. ..... 52/167.1
6,216,991 B1 * 4/2001 Okamoto ..... 248/188.1
7,114,302 B2 * 10/2006 Tanase et al. ..... 52/220.1

FOREIGN PATENT DOCUMENTS

JP 4-140362 A 5/1992
JP 5-52028 A 3/1993
JP 2007040093 2/2007

OTHER PUBLICATIONS

Chinese Office Action Dated Jul. 6, 2011, issued in Application No. 200810184545.7.

* cited by examiner

*Primary Examiner* — William Gilbert
*Assistant Examiner* — Gisele Ford
(74) *Attorney, Agent, or Firm* — Sughrue Mion, PLLC

(57) ABSTRACT

A floor support has: a first elastic member that is disposed on a floor slab, and is elastically deformable, and damps vibrations; a supporting member supported on the first elastic member, and extending in a direction opposite the floor slab; a flooring material supported on the supporting member, and disposed with a gap between the flooring material and the floor slab; a second elastic member that is supported by the first elastic member, the supporting member or the flooring material at a supporting surface inclined with respect to a horizontal direction, and is elastically deformable, and damps vibrations; and a mass body supported at the second elastic member, and displaced by elastic deformation of the second elastic member, and damping vibrations.

16 Claims, 10 Drawing Sheets

FLOOR SUPPORT AND FLOOR STRUCTURE

CROSS-REFERENCE TO RELATED APPLICATIONS

This application claims priority under 35 USC 119 from Japanese Patent Applications No. 2007-318584, the disclosure of which is incorporated by reference herein.

BACKGROUND OF THE INVENTION

1. Field of the Invention

The present invention relates to a floor support that supports the flooring material of a double floor, and to a floor structure that is made to be a double floor via the floor support.

2. Description of the Related Art

There are cases in which, in order to improve the ability to cut-off the noise of an impact to the floor in a floor structure, a double floor structure is used in which a floor is provided a predetermined height above a floor substrate via supporting members. In such a double floor structure, there is a technique of damping vibrations from the floor by using an elastic body and a mass body, as disclosed in, for example, Japanese Patent Applications Laid-Open (JP-A) Nos. 4-140362 and 5-52028.

Usually, the spring constant of the elastic body, the mass of the mass body, and the like are determined in accordance with the vibration frequency characteristic of the floor that is constructed, in order to efficiently damp vibrations from the floor. The vibration frequency is proportional to the spring constant of the elastic body, and is inversely proportional to the mass of the mass body. Accordingly, if the spring constant of the elastic body can be made to be small, the mass of the mass body also can be made to be small, and the size of the mass body itself can be made to be small.

SUMMARY OF THE INVENTION

The present invention was made in view of the above-described circumstances, and an object thereof is to provide a floor support in which the size of a mass body can easily be designed to be compact, and a floor structure using the floor support.

A floor support of a first aspect of the present invention has: a first elastic member that is disposed on a floor slab, and is elastically deformable, and damps vibrations; a supporting member supported on the first elastic member, and extending in a direction opposite the floor slab; a flooring material supported on the supporting member, and disposed with a gap between the flooring material and the floor slab; a second elastic member that is supported by the first elastic member, the supporting member or the flooring material at a supporting surface inclined with respect to a horizontal direction, and is elastically deformable, and damps vibrations; and a mass body supported at the second elastic member, and displaced by elastic deformation of the second elastic member, and damping vibrations.

At the floor support of the first aspect, when vibrations are applied to the flooring material, the vibrations are transferred to the second elastic member. Due thereto, the second elastic member elastically deforms, and the mass body moves up and down so as to absorb the vibrations. The vibrations from the flooring material to the floor slab are thereby damped. The damped vibrations are further damped by the first elastic member and transmitted to the floor slab, and therefore, floor impact noise can be cut-off well.

At the floor support of the first aspect, the second elastic member is supported by the first elastic member, the supporting member or the flooring material, at a supporting surface that is inclined with respect to the horizontal direction. Accordingly, when the mass body moves up and down, shearing force acts on the second elastic body, the second elastic body elastically deforms including the component in the shearing direction, and the spring constant in the shearing direction contributes. The spring constant in the shearing direction is about ⅕ to 1/10 of the spring constant in the compression direction. Accordingly, even in a case of second elastic members that are made to be the same shape and the same qualities, the spring constant of the second elastic member of the present invention can be made to be smaller than in a case in which elastic deformation in only the compression direction arises. Due thereto, the mass body that is supported by the second elastic member also can be made to be small, and the floor support can be made to be compact.

In a floor support of a second aspect of the present invention, the second elastic member is held at the supporting surface that forms an angle of 0° to 45° with respect to a vertical direction plane.

By setting the supporting surface for supporting the second elastic member at 0° to 45° with respect to a vertical direction plane in this way, the spring in the shearing direction of the second elastic member can be used effectively.

A floor support of a third aspect of the present invention further has an intermediate supporting portion that is provided integrally with the supporting member and has a supporting surface, and the second elastic member is supported at the supporting surface.

By forming the supporting surface of the intermediate supporting portion that is integral with the supporting member in this way, the second elastic body can be supported easily.

In a floor support of a fourth aspect of the present invention, a concave portion is formed in the flooring material at a floor slab side, and the floor support further comprises a floor receiving portion that is disposed within the concave portion and is provided integrally with an upper portion of the supporting member and supports the flooring material, and the floor receiving portion has an accommodating space within the concave portion, and the mass body is disposed in the accommodating space.

In accordance with the above-described structure, because the mass body is disposed in the accommodating space, a large space beneath the flooring material can be ensured.

In a floor support of a fifth aspect of the present invention, an insertion hole is formed in the second elastic member and the mass body, and the supporting member is inserted in the insertion hole.

In this way, the supporting member can be disposed so as to be inserted in the second elastic member and the mass body.

In a floor support of a sixth aspect of the present invention, the second elastic member is fixed to a position at which the second elastic member is disposed, and the mass body is fixed to the second elastic member.

By fixing the second elastic member and the mass body in this way, the transmission of vibrations from the member that is supported can be received well.

A floor structure of a seventh aspect of the present invention includes: a floor slab; and the floor support of any one of claim 1 through claim 6 disposed on the floor slab.

In accordance with the floor structure of the present invention, the mass body can be made to be small, and the floor structure can be made to be compact.

In a floor structure of an eighth aspect of the present invention, the floor slab is formed from concrete.

In accordance with the above-described structure, the vibrations applied to the flooring material are damped by a beam member, the mass body and the first elastic member, and thereafter, are transmitted to the floor slab that is made of concrete.

As described above, in accordance with the floor support and the floor structure of the present invention, the mass body can easily be made to be small, and the floor support can be made to be compact.

BRIEF DESCRIPTION OF THE DRAWINGS

Exemplary embodiments of the present invention will be described in detail based on the following figures, wherein.

DETAILED DESCRIPTION OF THE INVENTION

[First Exemplary Embodiment]

Figure 1:
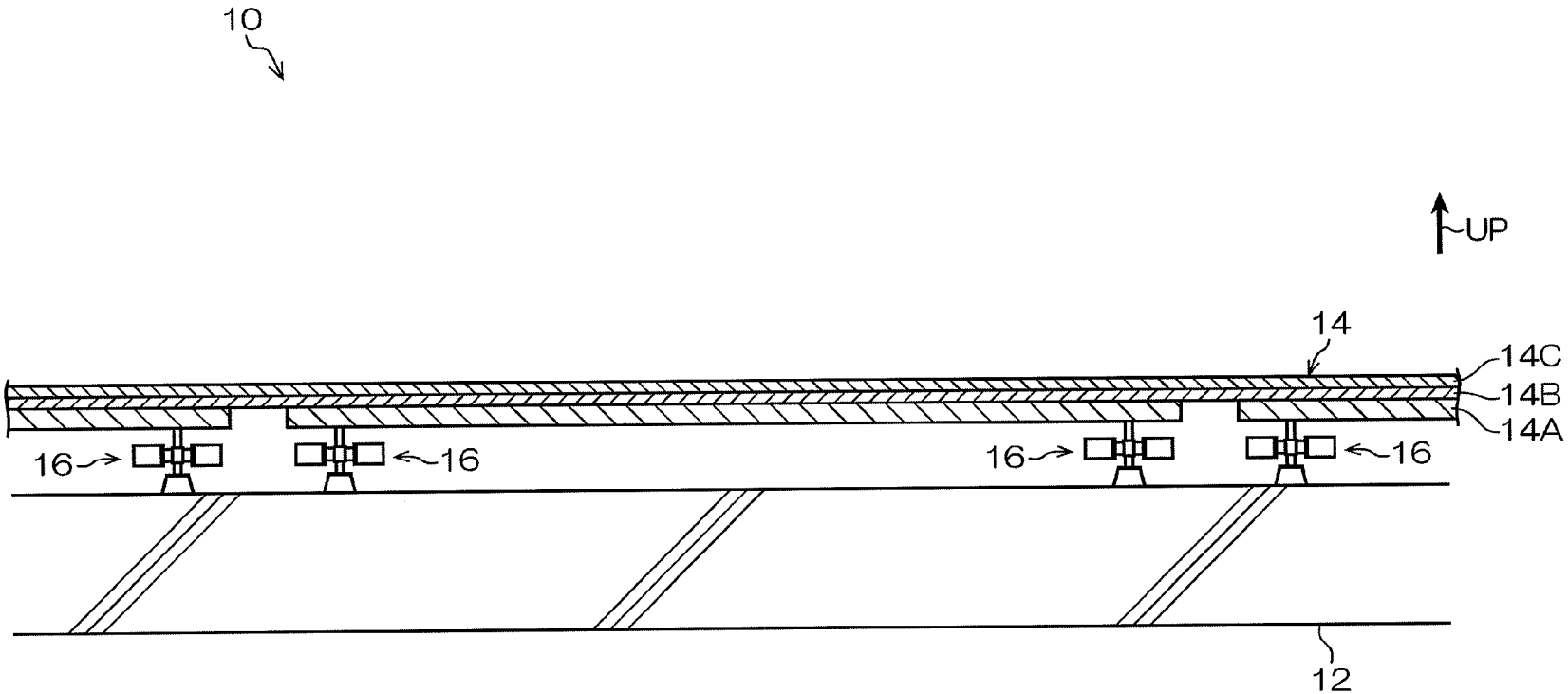
FIG. 1 is a drawing showing a floor structure relating to a first exemplary embodiment.

A first exemplary embodiment of a floor structure and a floor support that is applied to the floor structure in the present invention will be described on the basis of the drawings. Note that arrow UP in the drawings denotes the upward direction of the floor structure.

(Floor Structure and Structure of Floor Support)

A floor structure 10 shown in FIG. 1 is the structure of a double floor (a dry-type noise-insulating double floor) that is mainly used in collective housing, and is a structure for reducing floor impact noise (the noise of walking, the noise of an object dropping, the noise of children jumping around, and the like) that is generated at an upper level and propagates to the level beneath.

At the floor structure 10, plural floor supports 16 that are lined-up at a predetermined interval are interposed between a floor slab 12, that is formed of concrete and is a skeleton floor, and an upper flooring material 14. By interposing the floor supports 16, there is a state in which a space is formed between the floor slab 12 and the upper flooring material 14 and a noise-insulating effect is obtained.

Figure 2:
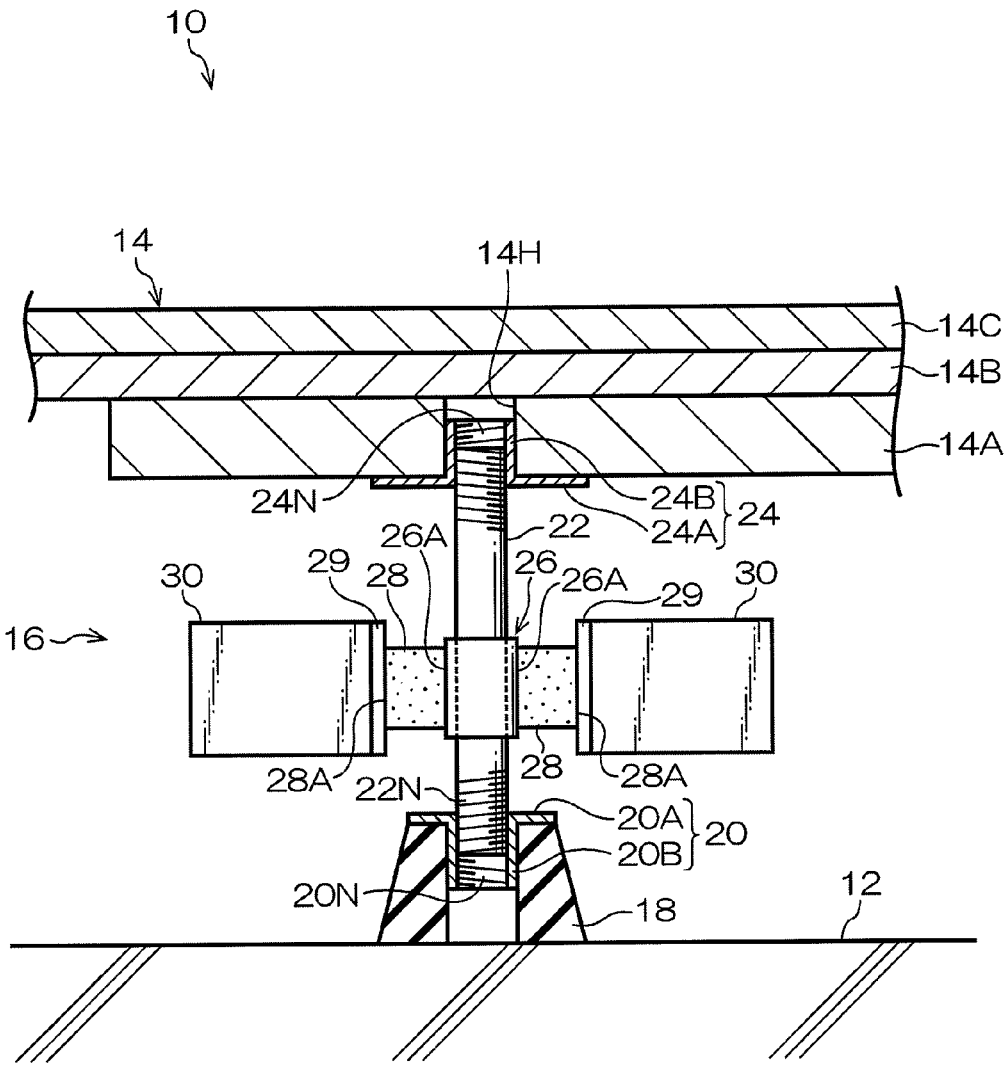
FIG. 2 is a cross-sectional view of the floor structure and a floor support relating to the first exemplary embodiment.

As shown in FIG. 2 as well, the upper flooring material 14 of the present exemplary embodiment is a layered structure that has a substrate panel 14A, and in which a backing material 14B is provided on the substrate panel 14A, and further, a finishing material 14C is provided on the backing material 14B. Here, the upper flooring material 14 other than the finishing material 14C (i.e., the substrate panel 14A and the backing material 14B) and the floor supports 16 are floor substrate materials. Through-holes 14H (see FIG. 2), for setting of the floor supports 16, are formed at predetermined intervals in the substrate panel 14A.

Figure 3:
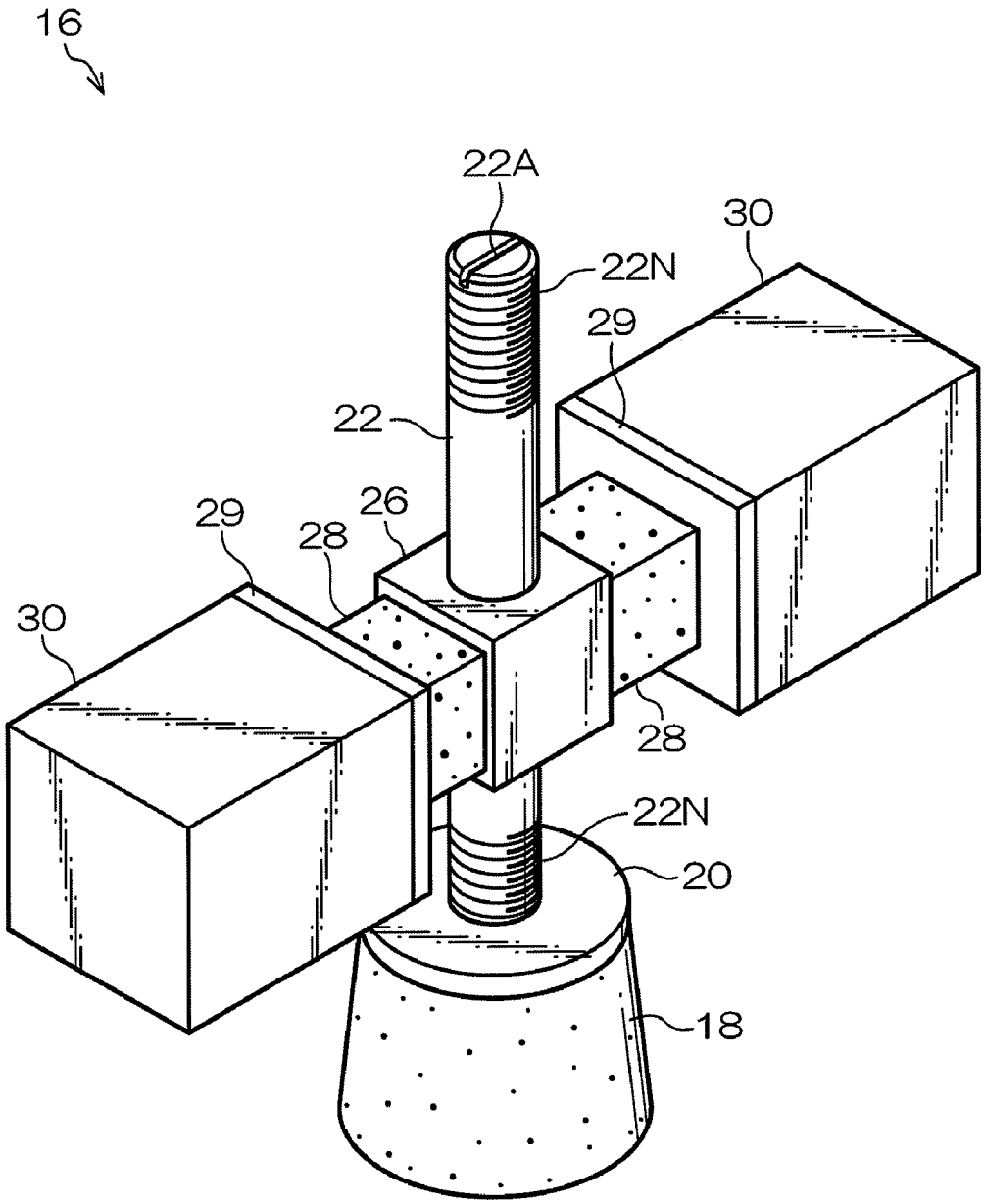
FIG. 3 is a perspective view of the floor support relating to the first exemplary embodiment.

As shown in FIG. 3 as well, the floor support 16 has a cushion rubber 18 serving as a first elastic member. The cushion rubber 18 is disposed on the floor slab 12. The cushion rubber 18 is shaped as a cylindrical tube, and is supported on the floor slab 12 in order to damp vibrations from the upper flooring material 14, and is elastically deformable.

A supporting bolt 22 is supported in an upright state above the cushion rubber 18 via a receiving member 20. The receiving member 20 has a cylindrically-tubular portion 20B that is cylinder-tube-shaped, and a disc-shaped flange portion 20A that is structured at the radial direction outer side of one end of the cylindrically-tubular portion 20B. The side of the cylindrically-tubular portion 20B, that is at the opposite side of the flange portion 20A, is inserted in the inner side of the tube of the cushion rubber 18, and the bottom surface of the flange portion 20A (the surface facing the cushion rubber 18) is fixed to the top surface of the cushion rubber 18 (the surface at the side opposite the floor slab 12 side surface). A female screw 20N is formed at the inner peripheral surface of the cylindrically-tubular portion 20B. A male screw 22N, that is formed at the shaft portion of the supporting bolt 22 that will be described later, is screwed together with the female screw 20N. The receiving member 20 is thereby made integral with the supporting bolt 22.

The supporting bolt 22 extends toward the side opposite the cushion rubber 18, i.e., in the direction opposite the floor slab 12, and is disposed so as to support the upper flooring material 14 via a panel receiving member 24. The panel receiving member 24 has a cylindrically-tubular portion 24B that is cylinder-tube-shaped, and a disc-shaped collar portion 24A that is structured at the radial direction outer side of one end of the cylindrically-tubular portion 24B. The cylindrically-tubular portion 24B of the panel receiving member 24 is inserted in and fixed to the interior of the through-hole 14H of the substrate panel 14A. The top surface of the collar portion 24A (the surface facing the upper flooring material 14) is fixed to the bottom surface of the substrate panel 14A (the surface at the side facing the floor slab 12). A female screw 24N is formed at the inner peripheral surface of the cylindrically-tubular portion 24B of the panel receiving member 24. The male screw 22N, that is formed at the shaft portion of the supporting bolt 22, is screwed-together with the female screw 24N. Due thereto, the upper flooring material 14 is disposed with a gap between the upper flooring material 14 and the floor slab 12.

A concave portion 22A (see FIG. 3) for insertion of a flathead screwdriver is formed in the distal end portion of the supporting bolt 22. The height of the substrate panel 14A from the floor slab 12 can be adjusted by, in the state before the backing material 14B and the finishing material 14C are laid on the substrate panel 14A of the upper flooring material 14, inserting a flathead screwdriver into the concave portion of the supporting bolt 22 and rotating the supporting bolt 22.

An intermediate supporting member 26 is disposed at the intermediate portion of the supporting bolt 22. The intermediate supporting member 26 is shaped as a quadrilateral column, and an insert-through-hole, through which the supporting bolt 22 can be inserted, is formed in the central portion thereof. The intermediate supporting member 26 is fixed to the supporting bolt 22 in a state in which the supporting bolt 22 is inserted therethrough. The fixing of the intermediate supporting member 26 to the supporting bolt 22 can be carried out by forming a female screw at the inner side of the intermediate supporting member 26, forming a male screw at the outer side of the supporting bolt 22, and screwing them together. Note that the fixing of the intermediate supporting member 26 to the supporting bolt 22 may be carried out by adhesion by an adhesive, or by another method. Supporting surfaces 26A, that are disposed in the vertical direction, are structured by a pair of outer side surfaces of the intermediate supporting member 26 that face one another.

A rubber member 28 is disposed at each of the supporting surfaces 26A. The rubber member 28 is parallelepiped, and one surface thereof is fixed to the supporting surface 26A such that the rubber member 28 is supported at the intermediate supporting member 26. The rubber members 28 and the intermediate supporting member 26 can be fixed together by adhesion by vulcanization.

Mass bodies 30 are disposed, via connecting members 29, at the sides of the rubber members 28 opposite the sides at which the intermediate supporting member 26 is located. The mass body 30 is parallelepiped, and one surface 28A thereof is fixed to one surface of the rectangular-plate-shaped connecting member 29. The other surface of the connecting member 29 is fixed to the rubber member 28, and the mass body 30 is supported at the rubber member 28. The connecting members 29 and the rubber members 28 can be fixed together by adhesion by vulcanization.

Note that, in the present exemplary embodiment, the mass bodies 30 and the rubber members 28 are connected via the connecting members 29. However, the connecting members 29 are not absolutely necessary, and the mass bodies 30 may be joined directly to the rubber members 28.

Here, a spring constant K of the rubber member 28 and a mass m of the mass body 30 are determined in accordance with the vibration frequency that is the object of damping, in order to efficiently damp vibrations from the upper flooring material 14. Given that the vibration frequency from the upper flooring material 14 to the floor slab 12 that is the object of damping=the natural frequency of the floor support 16=F1, and that the spring constant of the rubber member 28 is K and the mass of the mass body 30 is m, the natural frequency F1 can be expressed by following (Formula 1).

$$F1 = \frac{1}{2\pi}\sqrt{\frac{K}{m}} \qquad \text{(Formula 1)}$$

In the present exemplary embodiment, the rubber members 28 are supported at the supporting surfaces 26A that are disposed in a vertical direction, and shearingly deform when receiving vibrations from the upper flooring material 14. Usually, at a rubber member, the spring constant in the shearing direction is about ⅕ to 1/10 of the spring constant in the compression direction. Accordingly, if the rubber members 28 are made to be the same shape and have the same qualities, the spring constant can be made to be small as compared with a case in which the rubber members are disposed such that deformation only in the compression direction arises. Further, in order to obtain the natural frequency F1, the mass of the mass body 30 also can be made to be small from (Formula 1), and the size of the mass body 30 can be made to be compact.

Note that, in the present exemplary embodiment, the supporting surfaces 26A are disposed in the vertical direction. However, it is not absolutely necessary for the supporting surfaces 26A to be disposed in the vertical direction. It suffices for the supporting surfaces 26A to be supported in a direction in which shearing force is applied to the rubber members 28, in consideration of the desired natural frequency F1, the spring constant K required of the rubber members 28, and the like. However, in order to effectively utilize the spring constant in the shearing direction, it is preferable that the supporting surfaces 26A be at an angle of 0° to 45° with respect to a vertical direction plane.

Note that the material structuring the mass body 30 is not particularly limited provided that it has mass, and any type of mass body can be used. For example, iron, water, sand, or the like can be used.

(Floor Structure Constructing Processes)

Next, the constructing processes at the time of structuring the double-floor floor structure 10 by using the floor support 16 shown in FIG. 2 will be described.

First, the cushion rubber 18 and the receiving member 20 that have been made integral are, with the cushion rubber 18 at the lower side, placed on the floor slab 12. Next, the supporting bolt 22, with which the integrated intermediate supporting member 26, rubber members 28 and mass bodies 30 have been made integral, is screwed-in into the receiving member 20 from above. Namely, the male screw 22N of the supporting bolt 22 is screwed-together with and attached to the female screw 20N of the receiving member 20, and is made to stand upright.

Next, the female screw 24N of the panel receiving member 24 is screwed-together with the male screw 22N at the upper portion of the supporting bolt 22. Then, the substrate panel 14A is laid on the collar portion 24A of the panel receiving member 24, and the substrate panel 14A is fixed to the panel receiving member 24. Here, the height of the substrate panel 14A from the floor slab 12 is adjusted by inserting a flathead screwdriver into the concave portion 22A of the supporting bolt 22 from the through-hole 14H and rotating the supporting bolt 22.

Next, the backing material 14B is laid on the substrate panel 14A, and the finishing material 14C is laid on the backing material 14B. The double-floor floor structure 10 is thereby structured.

(Vibration Absorbing Operation of Floor Support)

The vibration absorbing operation of the floor support of the present exemplary embodiment will be described next.

The vibrations of a floor impact noise (e.g., the noise of walking or the like) that are generated at the level above are transmitted from the upper flooring material 14 to the rubber members 28 via the panel receiving member 24, the supporting bolt 22 and the intermediate supporting member 26. Due thereto, the rubber members 28 elastically deform and the mass bodies 30 move up and down so as to absorb the vibrations, and the vibrations are thereby damped. At this time, because the rubber members 28 are supported by the supporting surfaces 26A that are disposed in a vertical direction, the rubber members 28 elastically deform in the shearing direction at the time of moving up and down.

The damped vibrations are further damped by the cushion rubber 18, and are transmitted to the floor slab 12. Therefore, the floor impact noise is cut-off well.

As described above, in accordance with the floor structure 10 of the present exemplary embodiment, vibrations from the upper flooring material 14 to the floor slab 12 can be absorbed well by providing the floor supports 16.

Moreover, because the spring constant in the shearing direction of the rubber members 28 is utilized, the mass bodies 30 can be designed to be compact.

Figure 4:
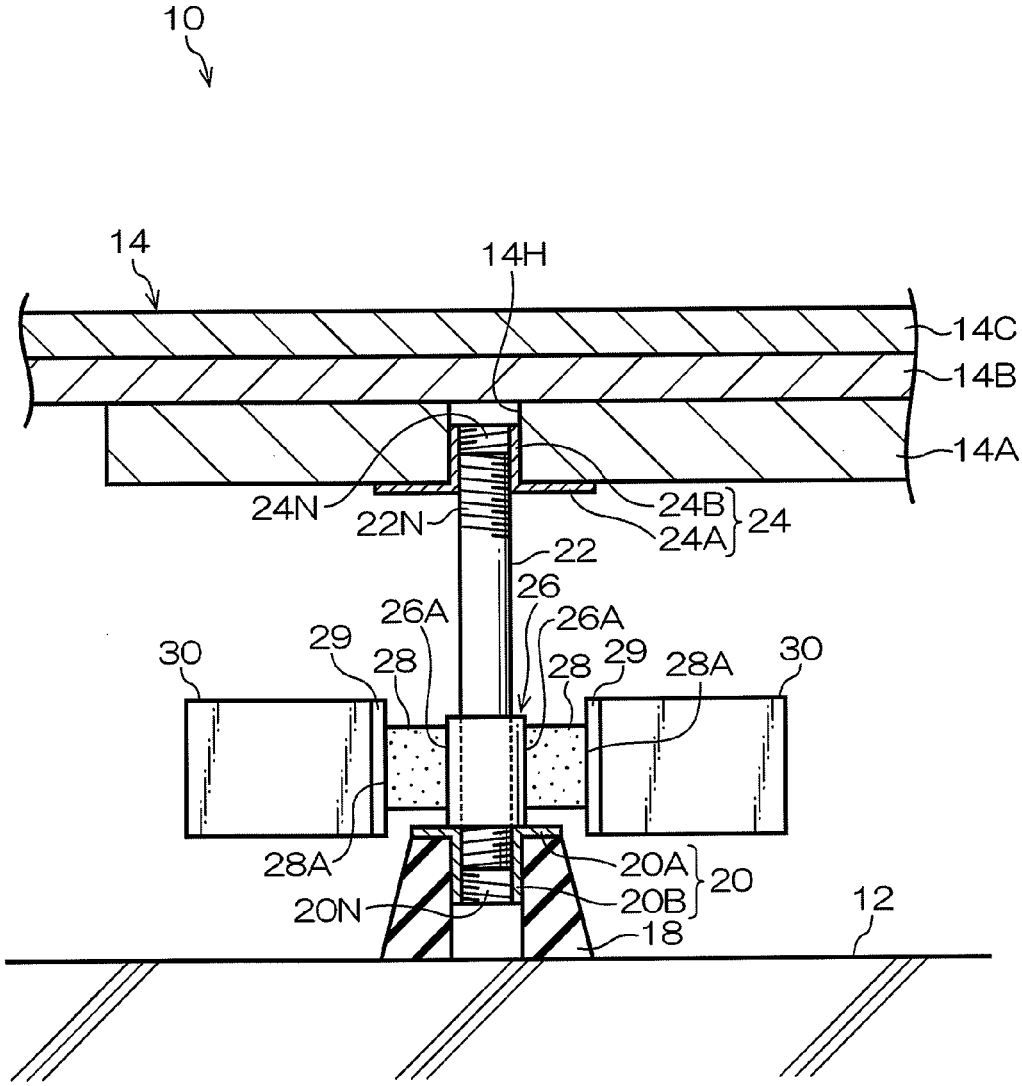
FIG. 4 is a cross-sectional view of a modified example of the floor support relating to the first exemplary embodiment.

Note that the present exemplary embodiment describes an example in which the intermediate supporting member 26 is made integral with the supporting bolt 22 in a state in which the intermediate supporting member 26 is apart from the receiving member 20. However, as shown in FIG. 4, the intermediate supporting member 26 may be fixed on the receiving member 20.

Figure 5:
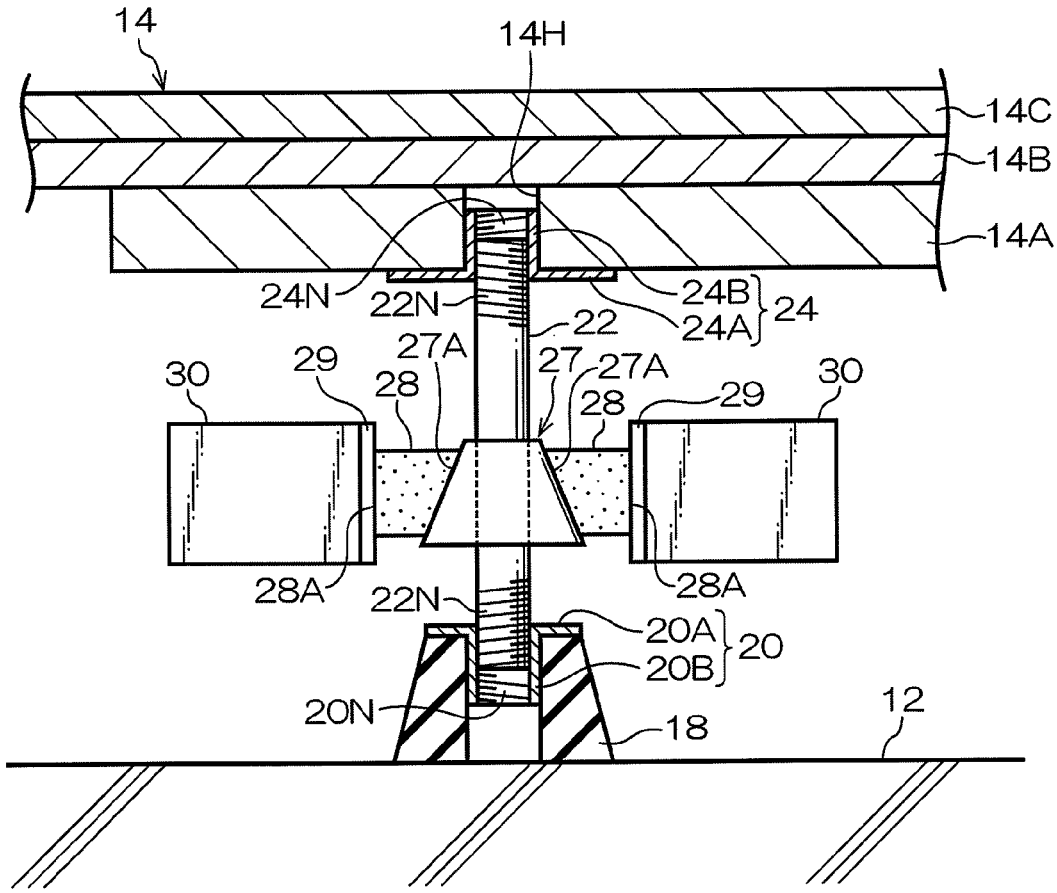
FIG. 5 is a cross-sectional view of another modified example of the floor support relating to the first exemplary embodiment.

Further, the present exemplary embodiment describes an example in which the supporting surfaces 26A that support the rubber members 28 are disposed in a vertical direction. However, the supporting surfaces 26A do not necessarily have to be in a vertical direction, and, as shown in FIG. 5, may be at an angle with respect to the vertical direction. In this case, an intermediate supporting member 27 may be formed in the shape of a truncated pyramid, and the pair of inclined side surfaces that are disposed opposingly may be made to be supporting surfaces 27A.

Figure 6:
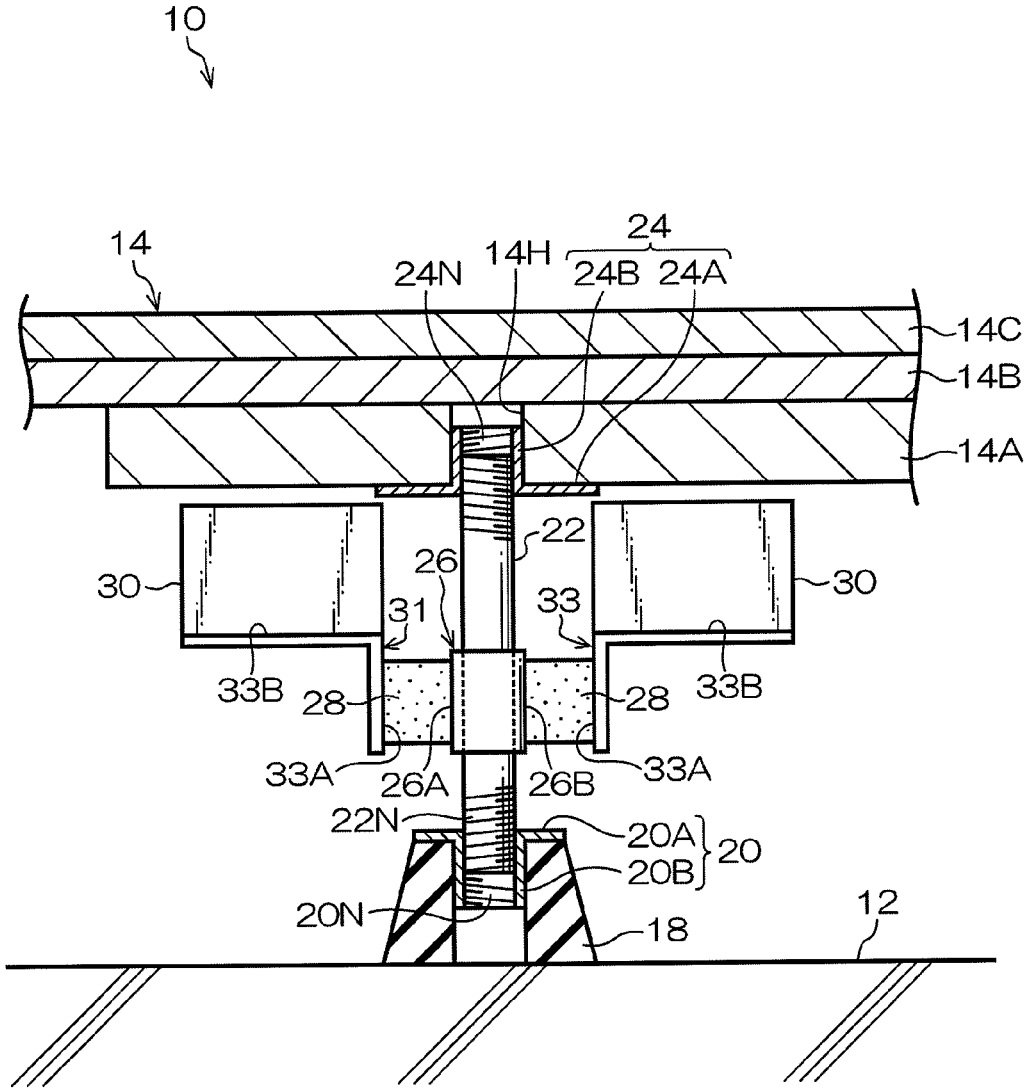
FIG. 6 is a cross-sectional view of yet another modified example of the floor support relating to the first exemplary embodiment.

Still further, in the present exemplary embodiment, the connecting members that connect the rubber members 28 and the mass bodies 30 are rectangular-plate-shaped. However, as shown in FIG. 6, the plate-shaped connecting member may be made to be an L-shaped connected member 33, and one surface 33A thereof may be fixed to the outer side surface of the rubber member 28, and another surface 33B thereof may be disposed in the horizontal direction and the mass body 30 fixed thereon.

Figure 7:
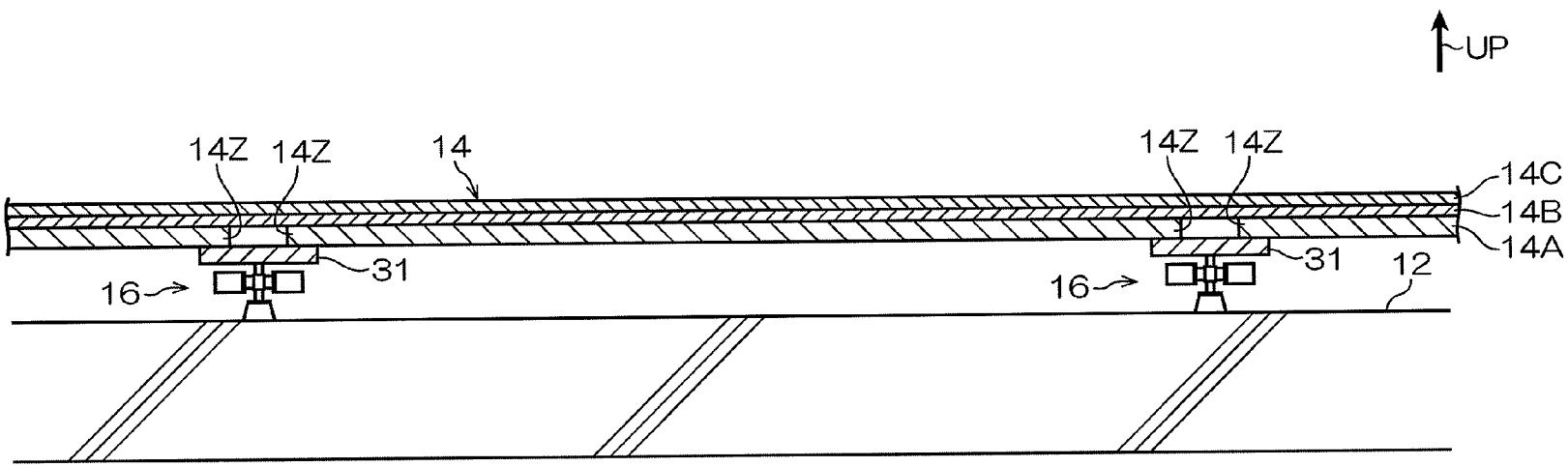
FIG. 7 is a drawing showing a modified example of the floor structure relating to the first exemplary embodiment.

Moreover, as shown in FIG. 7, the floor support 16 may support both of two adjacent substrate panels 14A. In this case, a panel receiving seat 31, that commonly supports corner portions 14Z of the substrate panels 14A that are lined-up adjacent to one another, is provided, and the supporting bolt 22 is mounted to the bottom portion of the panel receiving seat 31.

[Second Exemplary Embodiment]

A second exemplary embodiment will be described next. In the second exemplary embodiment, portions that are similar to those of the first exemplary embodiment are illustrated by being denoted by the same reference numerals, and detailed description thereof is omitted. The features of the present exemplary embodiment are that the rubber members 28 that serve as second elastic members and the mass bodies 30 are connected to the upper portion of the supporting bolt 22, and that a concave portion is formed in the upper flooring material 14. The other structures are substantially the same as the first exemplary embodiment.

Figure 8:
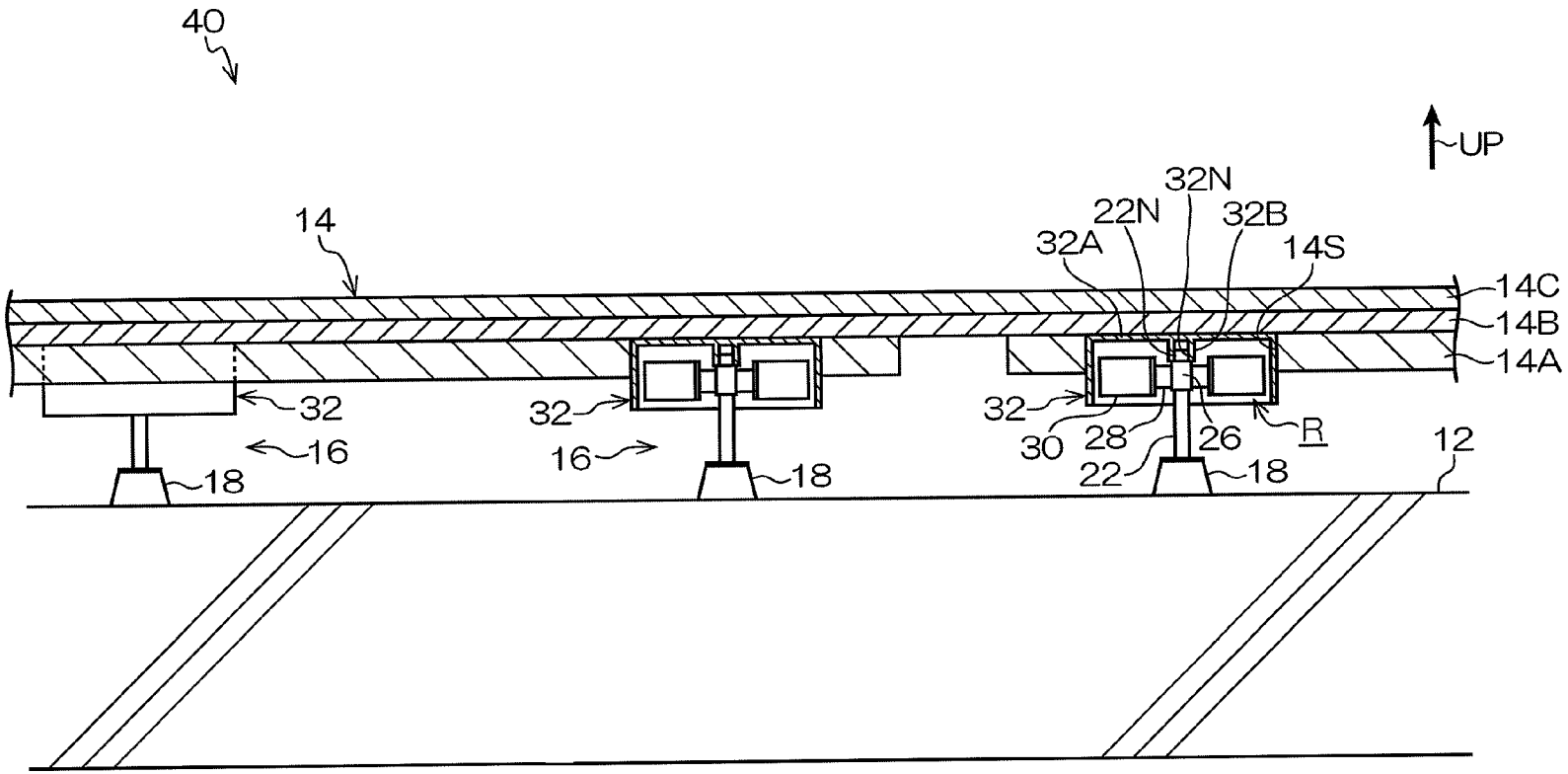
FIG. 8 is a drawing showing a floor structure relating to a second exemplary embodiment.

As shown in FIG. 8, a concave portion 14S is formed in the floor slab 12 side of the upper flooring material 14 of a floor structure 40 of the present exemplary embodiment. The concave portion 14S is formed such that the upper opening portion of a through-hole formed in the substrate panel 14A is closed-off by the backing material 14B. Here, the diameter of the through-hole of the substrate panel 14A is larger than the diameter of the through-hole 14H in the first exemplary embodiment.

An upper floor receiving member 32 serving as a floor receiving portion is disposed within the concave portion 14S. The upper floor receiving member 32 is shaped as a cylindrical tube having a floor, and is fit-into the concave portion 14S with a floor portion 32A being at the upper side. A projecting portion 32B, that projects from the floor portion 32A and at whose inner side a female screw portion 32N is formed, is structured at the central portion of the floor portion 32A. The male screw portion 22N of the upper portion of the supporting bolt 22 is screwed-together with the female screw portion 32N such that the supporting bolt 22 is made integral with the upper floor receiving member 32. An accommodating space R is formed at the inner side of the tube of the upper floor receiving member 32.

The intermediate supporting member 26 is fixed to the upper portion of the supporting bolt 22. The rubber members 28 are fixed to the supporting surfaces 26A of the intermediate supporting member 26, and the mass bodies 30 are fixed to the opposite sides of the rubber members 28. Portions of the rubber members 28 and the mass bodies 30 are disposed in the accommodating space R.

By disposing the mass bodies 30 within the accommodating space R in this way, a large space between the upper flooring material 14 and the floor slab 12 can be ensured, and the degrees of freedom of the wiring beneath the floor and the like increase.

[Third Exemplary Embodiment]

A third exemplary embodiment will be described next. In the third exemplary embodiment, portions that are similar to those of the first and second exemplary embodiments are illustrated by being denoted by the same reference numerals, and detailed description thereof is omitted. In the present exemplary embodiment, the shapes of the intermediate supporting member, the rubber member and the mass body of the floor support differ from those in the first and second exemplary embodiments. The other structures are substantially the same structures.

Figure 9A:
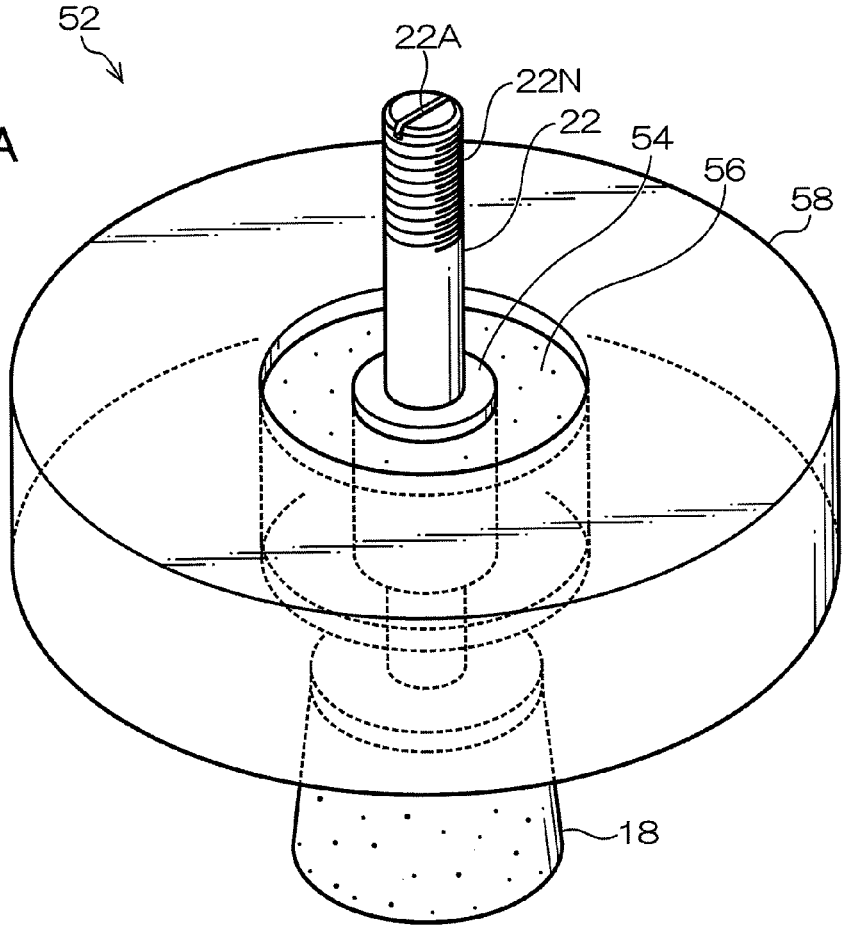
FIG. 9A is a perspective view of a floor support relating to a third exemplary embodiment.
Figure 9B:
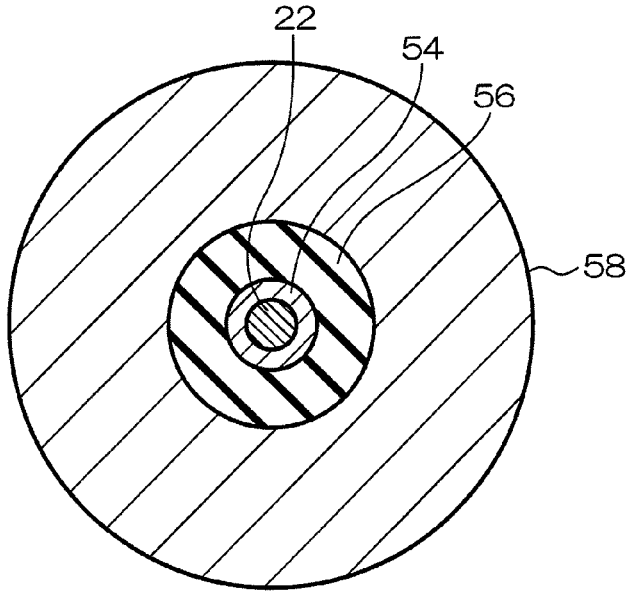
FIG. 9B is a cross-sectional view in a horizontal direction of the floor support relating to the third exemplary embodiment.

As shown in FIG. 9A and FIG. 9B, the floor structure of the present exemplary embodiment has a floor support 52. An intermediate supporting member 54 is disposed at the intermediate portion of the supporting bolt 22 of the floor support 52. The intermediate supporting member 54 is cylinder-tube-shaped, and the supporting bolt is inserted through and fixed to the tube interior. The entire side surface of the intermediate supporting member 54 is a supporting surface 54A.

A rubber member 56 that serves as a second elastic member is formed in the shape of a cylindrical tube that surrounds the outer periphery of the intermediate supporting member 54. The inner peripheral surface of the rubber member 56 is fixed to and supported at the supporting surface 54A. A mass body 58 is formed in the shape of a cylindrical tube that surrounds the outer periphery of the rubber member 56. The inner peripheral surface of the mass body 58 is fixed to the side surface of the rubber member 56. Here, the intermediate supporting member 54 and the rubber member 56, and also the fixing of the rubber member 56 and the mass body 58, can be carried out by adhesion by vulcanization.

In the floor support 52 of the above-described structure, because the rubber member 56 is disposed so as to surround the supporting bolt 22, the rubber member 56 elastically deforms along the supporting bolt 22. Further, because the mass body 58 as well is disposed so as to surround the supporting bolt 22, the mass body 58 moves along the supporting bolt 22. Therefore, the operation of dynamic damping is stable.

Figure 10A:
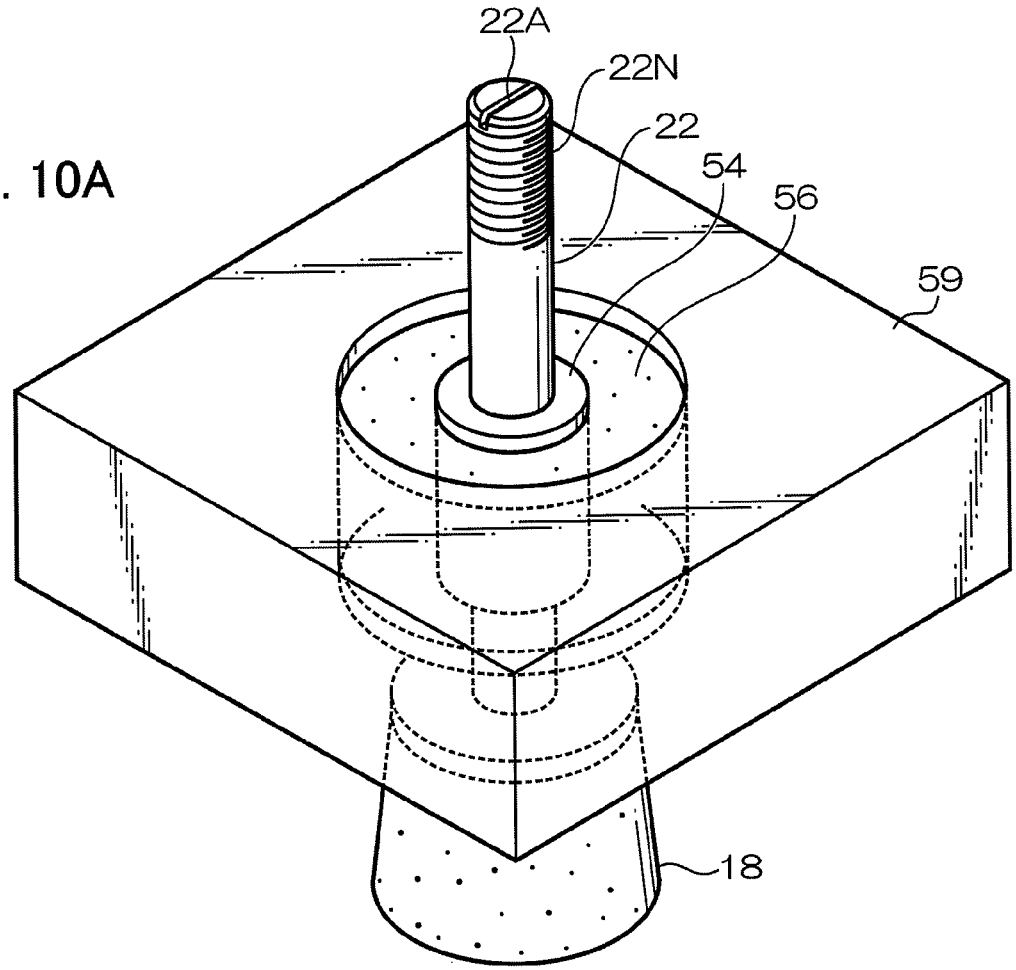
FIG. 10A is a perspective view of a modified example of the floor support relating to the third exemplary embodiment.
Figure 10B:
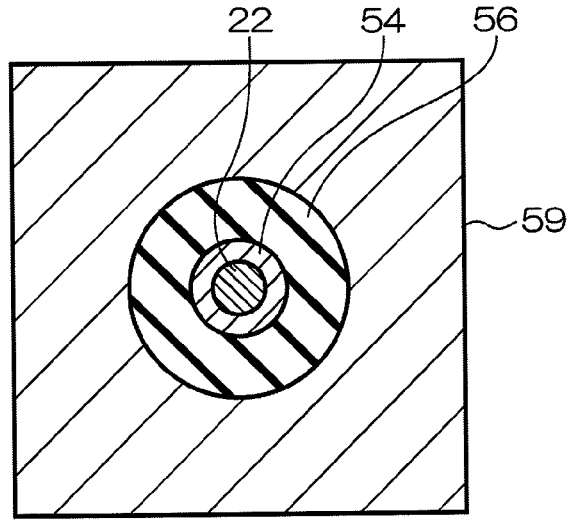
FIG. 10B is a cross-sectional view in a horizontal direction of the modified example of the floor support relating to the third exemplary embodiment.

Further, in the present exemplary embodiment, the intermediate supporting member, the rubber member and the mass body are cylinder-tube-shaped. However, as shown in FIG. 10A and FIG. 10B, the mass body may be a parallelepiped mass body 59.

Note that the above first through third exemplary embodiments describe cases in which the floor slab 12 is a concrete floor that is made of concrete, but the floor slab may be another floor slab that is formed of wood or the like.

What is claimed is:

1. A floor support comprising:

a first elastic member that is disposed on a floor slab, and is elastically deformable, and damps vibrations;

a supporting member supported on the first elastic member, and extending in a direction opposite the floor slab;

a flooring material supported on the supporting member, and disposed with a gap between the flooring material and the floor slab;

a second elastic member that is supported by the supporting member at a supporting surface inclined with respect to a vertical direction, and is elastically deformable, and damps vibrations, an inclination angle of the supporting surface being greater than 0° and less than or equal to 45°; and a mass body supported at the second elastic member, and displaced by elastic deformation of the second elastic member, and damping vibrations, wherein the mass body is disposed apart from the flooring material.

2. The floor support of claim 1, further comprising an intermediate supporting portion that is provided integrally with the supporting member and has the supporting surface, and the second elastic member is supported at the supporting surface.

3. The floor support of claim 1, wherein a concave portion is formed in the flooring material at a floor slab side, and the floor support further comprises a floor receiving portion that is disposed within the concave portion and is provided integrally with an upper portion of the supporting member and supports the flooring material, and the floor receiving portion has an accommodating space within the concave portion, and the mass body is disposed in the accommodating space.

4. The floor support of claim 2, wherein a concave portion is formed in the flooring material at a floor slab side, and the floor support further comprises a floor receiving portion that is disposed within the concave portion and is provided integrally with an upper portion of the supporting member and supports the flooring material, and the floor receiving portion has an accommodating space within the concave portion, and the mass body is disposed in the accommodating space.

5. The floor support of claim 1, wherein an insertion hole is formed in the second elastic member and the mass body, and the supporting member is inserted in the insertion hole.

6. The floor support of claim 2, wherein an insertion hole is formed in the second elastic member and the mass body, and the supporting member is inserted in the insertion hole.

7. The floor support of claim 3, wherein an insertion hole is formed in the second elastic member and the mass body, and the supporting member is inserted in the insertion hole.

8. The floor support of claim 4, wherein an insertion hole is formed in the second elastic member and the mass body, and the supporting member is inserted in the insertion hole.

9. The floor support of claim 1, wherein the second elastic member is fixed to a position at which the second elastic member is disposed, and the mass body is fixed to the second elastic member.

10. The floor support of claim 2, wherein the second elastic member is fixed to a position at which the second elastic member is disposed, and the mass body is fixed to the second elastic member.

11. The floor support of claim 3, wherein the second elastic member is fixed to a position at which the second elastic member is disposed, and the mass body is fixed to the second elastic member.

12. The floor support of claim 4, wherein the second elastic member is fixed to a position at which the second elastic member is disposed, and the mass body is fixed to the second elastic member.

13. The floor support of claim 5, wherein the second elastic member is fixed to a position at which the second elastic member is disposed, and the mass body is fixed to the second elastic member.

14. The floor support of claim 1, wherein the supporting member has a greater length in the extending direction opposite the floor slab than in a direction parallel to the floor slab.

15. A floor support comprising: a first elastic member that is disposed on a floor slab, and is elastically deformable, and damps vibrations; a supporting member supported on the first elastic member, and extending in a direction opposite the floor slab; a flooring material supported on the supporting member, and disposed with a gap between the flooring material and the floor slab; a second elastic member that is supported by the supporting member at a supporting surface inclined with respect to a vertical direction, and is elastically deformable, and damps vibrations, an inclination angle of the supporting surface being greater than 0° and less than or equal to 45°; and a mass body supported at the second elastic member, and displaced by elastic deformation of the second elastic member, and damping vibrations, wherein the mass body is disposed apart from the flooring material.

16. The floor structure of claim 15, wherein the floor slab is formed from concrete.

* * * * *